US006085725A

United States Patent [19]

Goode et al.

[11] Patent Number: 6,085,725

[45] Date of Patent: Jul. 11, 2000

[54] THROTTLE CONTROL RESPONSE SELECTION SYSTEM

[75] Inventors: Charles E. Goode; Michael G. McKenna, both of Columbus, Ind.

[73] Assignee: Cummins Engine Co., Inc., Columbus, Ind.

[21] Appl. No.: 09/316,858

[22] Filed: May 21, 1999

Related U.S. Application Data

[63] Continuation of application No. 09/156,473, Sep. 18, 1998.
[60] Provisional application No. 60/076,485, Mar. 2, 1998.

[51] Int. Cl.[7] ..... F02M 37/04
[52] U.S. Cl. ..... 123/357
[58] Field of Search ..... 123/357, 364

[56] References Cited

U.S. PATENT DOCUMENTS

| | | | |
|---|---|---|---|
| 4,551,803 | 11/1985 | Hosaka et al. | 364/431.05 |
| 4,669,436 | 6/1987 | Nanjyo et al. | 123/357 |
| 5,222,022 | 6/1993 | Adams et al. | 354/431.07 |
| 5,268,842 | 12/1993 | Marston et al. | 364/431.05 |
| 5,303,163 | 4/1994 | Ebaugh et al. | 364/550 |
| 5,323,746 | 6/1994 | Best et al. | 123/357 |
| 5,483,927 | 1/1996 | Letang et al. | 123/41.12 |
| 5,490,071 | 2/1996 | Akabane | 364/426.02 |
| 5,526,786 | 6/1996 | Beck et al. | 123/357 |
| 5,553,589 | 9/1996 | Middleton et al. | 123/352 |
| 5,564,999 | 10/1996 | Bellinger et al. | 477/111 |
| 5,613,474 | 3/1997 | Nakamura et al. | 123/357 |
| 5,625,558 | 4/1997 | Togai et al. | 364/426.041 |

FOREIGN PATENT DOCUMENTS

| | | |
|---|---|---|
| 0 106 360 | 4/1984 | European Pat. Off. . |
| 0 110 226 | 6/1984 | European Pat. Off. . |
| 2 154 763 | 9/1985 | United Kingdom . |
| 2 312 970 | 11/1997 | United Kingdom . |
| 2 314 944 | 1/1998 | United Kingdom . |
| 2 323 686 | 9/1998 | United Kingdom . |

*Primary Examiner*—Thomas N. Moulis
*Attorney, Agent, or Firm*—Woodard, Emhardt, Naughton, Moriarty & McNett

[57] ABSTRACT

A vehicle having an internal combustion engine with a throttle control is disclosed. The throttle control is responsive to a vehicle operator to generate a throttle setting signal to adjust vehicle speed. An operator-controlled input device is also provided to generate a selected signal corresponding to a selected one of a number of predetermined engine control relationships. A controller responds to the selection signal to govern engine operation in accordance with the selected one of the relationships and the throttle setting signal. The throttle control has a different performance characteristic for each of the relationships and is adjustable by the operator to increase or decrease speed for each of the relationships. The relationships may each correspond to a different type of engine governing technique and include different droop characteristics.

17 Claims, 5 Drawing Sheets

THROTTLE CONTROL RESPONSE SELECTION SYSTEM

CROSS-REFERENCE TO RELATED APPLICATIONS

The present application is a continuation of U.S. patent application Ser. No. 09/156,473, filed Sep. 18, 1998; and claims the benefit of U.S. Provisional Patent Application Serial No. 60/076,485, filed Mar. 2, 1998.

BACKGROUND OF THE INVENTION

The present invention relates to the control of internal combustion engines, and more particularly, but not exclusively, relates to the operator selectable response of an internal combustion engine control system to a throttle control for a vehicle.

In recent years, internal combustion engine performance has been improved through the application of sophisticated control systems. Typically, these systems utilize programmable processing equipment coupled to a number of engine sensors and controls. One result has been the replacement of strictly mechanical engine governors with electronic governing arrangements. For these arrangements, the accelerator pedal of the vehicle is deflected to electronically select an engine operating point corresponding to a desired vehicle speed. The determination of the operating point is usually in accordance with a multivariable control relationship defined by the engine's control system. Consequently, the "feel" of the accelerator pedal to the vehicle driver is influenced by the nature of this relationship.

Generally, the performance or feel of the accelerator pedal varies for a given type of relationship with factors such as vehicle loading, the type of vehicle, driving conditions, and the driver's personal preferences. The variation may be particularly noticeable for heavy-duty vehicles, such as trucks and buses, that often experience large differences in loading. Naturally, it would be desirable to reduce this variation as it may easily become distracting to the driver.

Therefore, there is a demand for a technique to offer a vehicle operator the choice between several different throttle control responses. The present invention meets this demand and provides other important benefits and advantages.

SUMMARY OF THE INVENTION

The present invention relates to the control of internal combustion engines. Various aspects of the present invention are novel, nonobvious and provide various advantages. While the actual nature of the invention covered herein may only be determined with reference to the claims appended hereto, certain features which are characteristic of the preferred embodiments disclosed herein are described briefly as follows.

One feature of the present invention is a technique to offer a vehicle operator a selection of different throttle control responses. This selection may be made by an operator using an input device such as a switch or other operator-controlled apparatus.

Another feature includes a method of: operating a vehicle powered by an internal combustion engine having a throttle control, selecting between at least two engine governing relationships with a selection device, and regulating operation of the engine with the selected one of the relationships. Response to the throttle control is different for each of the relationships and the throttle control is adjustable by the operator to increase or decrease engine speed and thereby correspondingly increase or decrease vehicle speed for each of these relationships. These different relationships may correspond to different types of engine governors. For example, a first one of the relationships may correspond to an all-speed governor and a second one of the relationships may correspond to a torque governor.

In a further feature, a vehicle is operated that is powered by an internal combustion engine having a throttle control. A selection may be made between at least two engine control relationships that each have a different droop characteristic to provide a correspondingly different throttle control quality to a throttle control operator. The throttle control is adjustable by the operator to increase or decrease engine speed for each of these relationships. The engine is regulated with a selected one of the relationships. Preferably, certain conditions are met before switching engine operation from one relationship to another. For example, changing control from one relationship to another may be conditioned on detecting a predetermined position of the throttle control and an engine load below a predetermined minimum. When the throttle control includes an accelerator pedal, the predetermined position may correspond to the undeflected position of the accelerator pedal.

In an additional feature, the present invention includes a vehicle and an internal combustion engine to power this vehicle. Also included are a throttle control responsive to a vehicle operator to generate a throttle setting signal to adjust engine speed and an operator-controlled input device to generate a selection signal corresponding to a selection made by the operator. Further included is a controller responsive to the selection signal to govern engine operation in accordance with a selected one of a number of different predetermined engine control relationships. The engine is controlled in accordance with the throttle setting signal and the selected one of the relationships. The throttle control has a different performance characteristic for each of the relationships and is adjustable by the operator to increase or decrease vehicle speed for each of the relationships.

In yet another feature, an apparatus includes a vehicle, an internal combustion engine powering the vehicle, a throttle control operatively coupled to the engine, and a means for operator selection of a performance characteristic of the throttle control. This means includes a number of engine control relationships each having a different droop property. The engine is regulated by this means in accordance with a selected one of the relationships and the throttle control.

Accordingly, it is one object of the present invention to provide for operator selection of a performance characteristic for a throttle control in a vehicle powered by an internal combustion engine.

It is another object to provide for selection between at least two engine, control relationships each having a correspondingly different throttle control quality to a throttle control operator.

An additional object is to select one of a number of engine governing relationships with an operator-controlled input device, where the relationships each correspond to a different performance characteristic of the throttle control.

Further objects, features, aspects, benefits, and advantages of the present invention shall become apparent from the drawings and description provided herein.

DESCRIPTION OF THE PREFERRED EMBODIMENT

Figure 1:
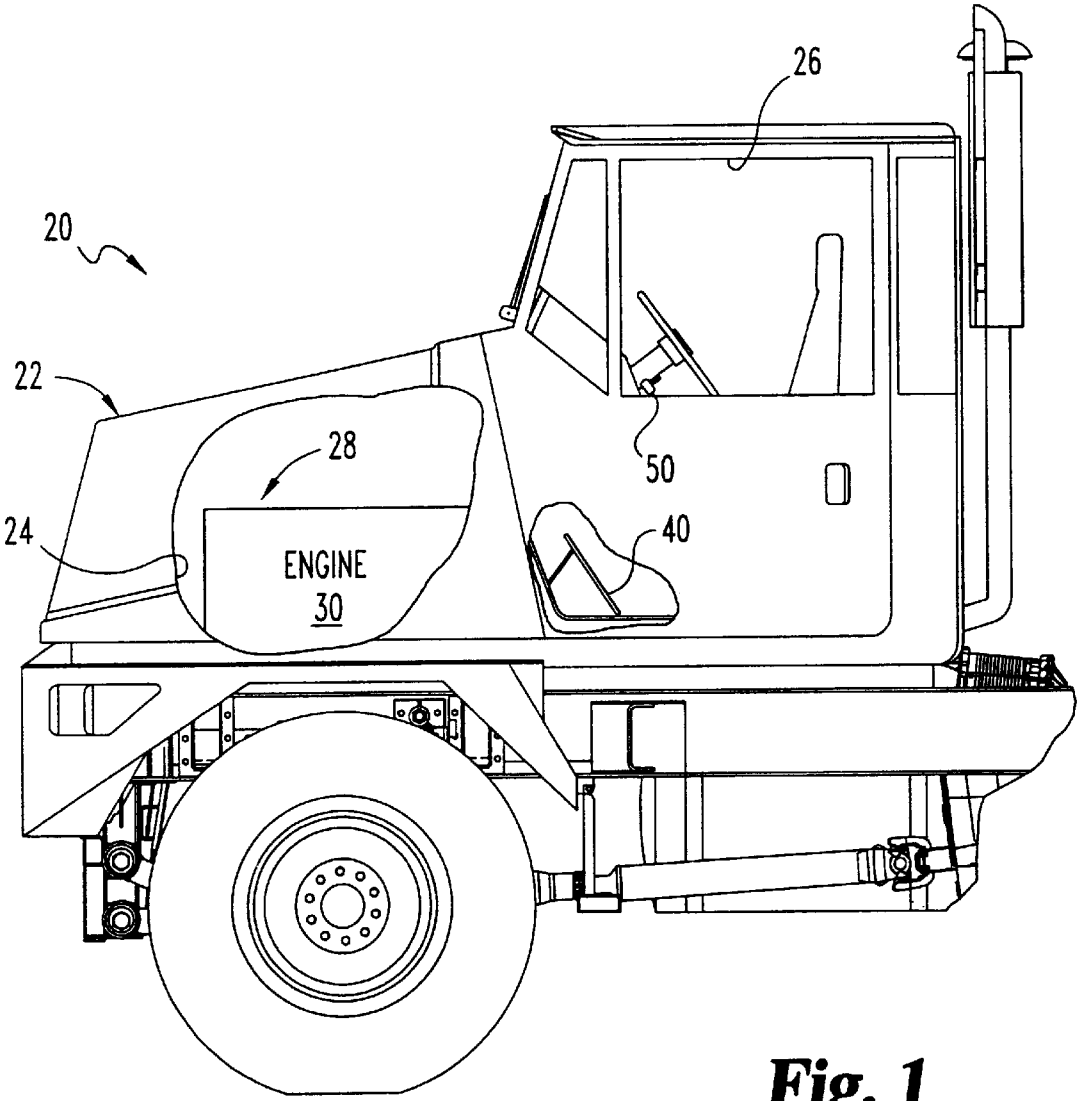
FIG. 1 is a partial cutaway view of a vehicle system of one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any alterations and further modifications in the described device, and any further applications of the principles of the invention as described herein are contemplated as would normally occur to one skilled in the art to which the invention relates.

FIG. 1 depicts vehicle system 20 of one embodiment of the present invention. System 20 includes ground transport vehicle 22 in the form of a heavy-duty truck/tractor. Vehicle 22 has an engine compartment 24 with a cutaway showing engine 30 inside. Vehicle 22 also has a driver's compartment 26. A cutaway view shows throttle control 40 within compartment 26. Also mounted in compartment 26 is an operator-controlled selection device 50. Vehicle 22 is propelled by prime mover 28 in the form of engine 30. Engine 30 is arranged as part of a drive train to propel vehicle 22 in the conventional manner. In other embodiments, a different prime mover 28, such as an electric motor, may be used to propel vehicle 22.

Figure 2:
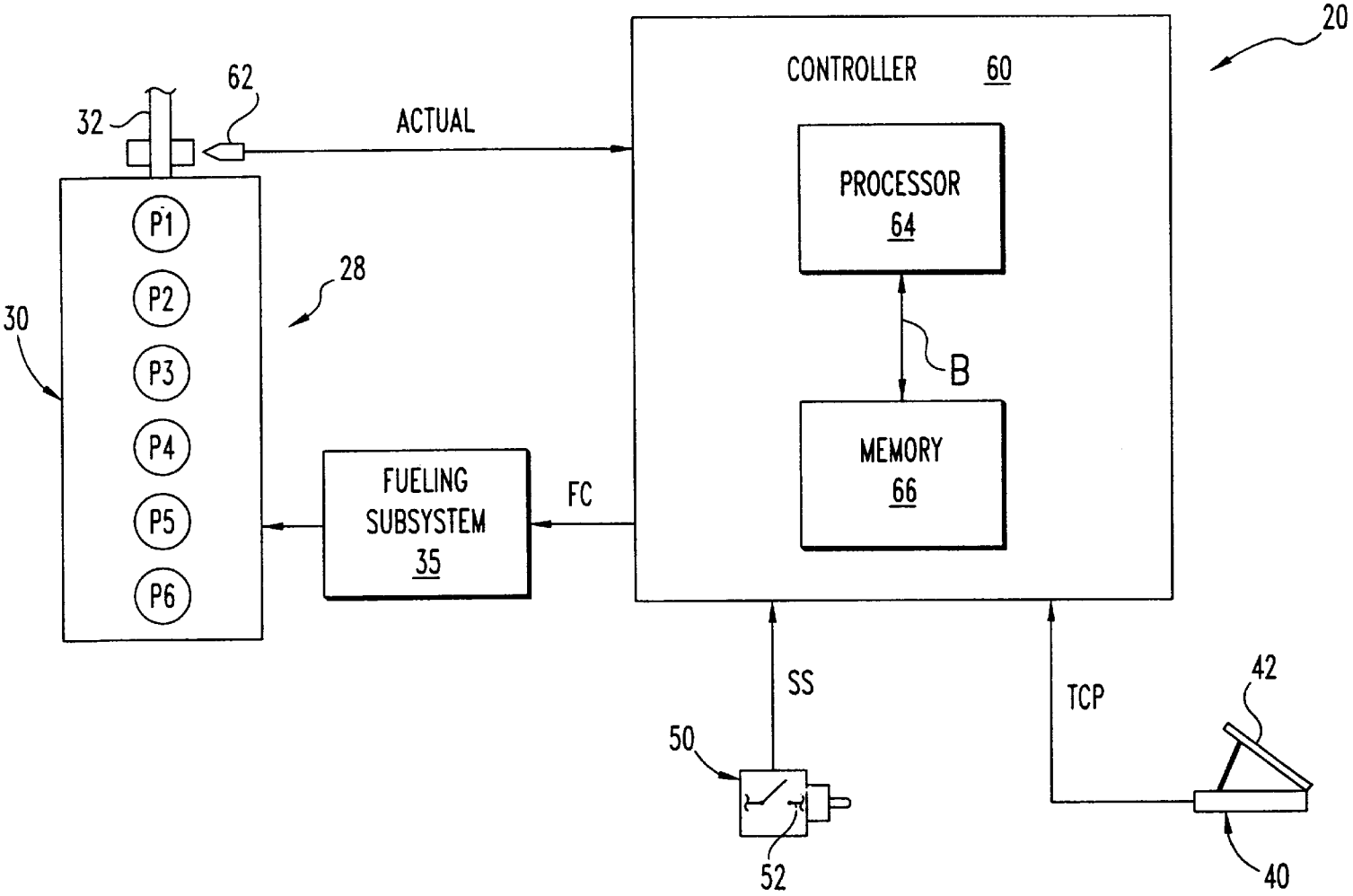
FIG. 2 is a schematic view of the embodiment of FIG. 1 showing additional aspects of the present invention.

Referring to the schematic view of FIG. 2, further aspects of system 20 are shown. Engine 30 is of the multistroke variety with crankshaft 32 being driven by a number of rotatably coupled reciprocating pistons P1–P6 each having a separate combustion chamber. Alternatively, engine 40 may be of a rotor-driven intermittent combustion variety or such other type of engine having noncontinuous internal combustion as would occur to those skilled in the art. Engine 30 may operate with one or more types of fuel including, but not limited to, diesel fuel, gasoline, or gaseous fuel. The fuel may be metered by port injection, upstream carburetion, or by other techniques known to those skilled in the art. Combustion may be initiated by spark ignition (SI), compression ignition (CI), or as would otherwise occur to those skilled in the art. Preferably, engine 30 is of a four-stroke, diesel-fueled variety with reciprocating pistons P1–P6 rotatably coupled to crankshaft 32 by connecting rods in a conventional manner.

Fueling of engine 30 is regulated by fueling subsystem 35. Fueling subsystem 35 provides fuel from a fuel source, such as a fuel tank (not shown). Fueling subsystem 35 is responsive to fuel command signals FC generated by engine controller 60. Preferably, subsystem 35 includes electronically controlled fuel injectors; however, other types of fueling subsystems may be utilized as would occur to those skilled in the art.

Throttle control 40 includes accelerator pedal 42. Pedal 42 is biased to an undeflected position corresponding to operation of engine 30 in an idle mode; however, accelerator pedal 42 may be deflected by a vehicle operator's foot to correspondingly adjust engine speed and thereby adjust vehicle speed. The degree of deflection of accelerator pedal 42 is detected with a sensor and provided as an input signal TCP to controller 60.

Operator-controlled selection device 50 of FIG. 2 includes switch 52 to provide corresponding selection states indicated by signal SS. Switch 52 is of the two-position variety configured to provide two states of single SS designated "ON" and "OFF". Alternatively, switch 52 may be of a momentary type which toggles between the "OFF" and "ON" states. In other embodiments, device may be configured to select from among more than two states, and may be provided by other types of input devices besides a switch as would occur to those skilled in the art including, but not limited to, the configurable vehicle monitoring system of U.S. Pat. No. 5,303,163 to Ebaugh et al.

Controller 60 includes processor 64 operatively coupled to memory 66 by communication bus B. Controller 60 also includes sensor 62 configured to detect a control parameter of engine 30 which is provided as signal ACTUAL. The format of signal ACTUAL sent by sensor 62 may be any format compatible with controller 60, including either a digital or analog format. Correspondingly, controller 60 includes equipment necessary to condition and convert signal ACTUAL into the appropriate format for various internal processing operations, as required. In one example, sensor 62 is configured to detect rotational engine speed by monitoring the revolution of crankshaft 32 in a conventional manner. In another arrangement, sensor 62 may be configured to detect torque generated by crankshaft 32 using a conventional torque detection arrangement. In still other embodiments, sensor 62 may be configured to detect a different type of control property of system 20 as would occur to those skilled in the art.

Processor 64 may be provided by one or more components. Preferably, processor 64 is an electronic circuit comprised of digital circuitry, analog circuitry, or both. It is also preferred that processor 64 be programmable, although processor 64 may alternatively by provided by dedicated hardware defining an integrated state machine, or a combination of programmable and dedicated hardware.

Memory 66 may include one or more components of the electronic (e.g. solid state), magnetic or optical variety readily available for use with electronic controllers or processors. Memory 66 may include an optical disk memory, an electromagnetic or floppy disk media, or a combination of these types. Memory 66 is preferably of the digital type suitable for interfacing with processor 64. Memory 66 preferably represents both volatile and nonvolatile memory components arranged to store instructions and data for processor 64; however, memory 66 may alternatively be provided by a single component of a single memory type. In one alternative embodiment, controller 60 is provided by a single integrated circuit device embodying processor 64, memory 66, and bus B.

Figure 3:
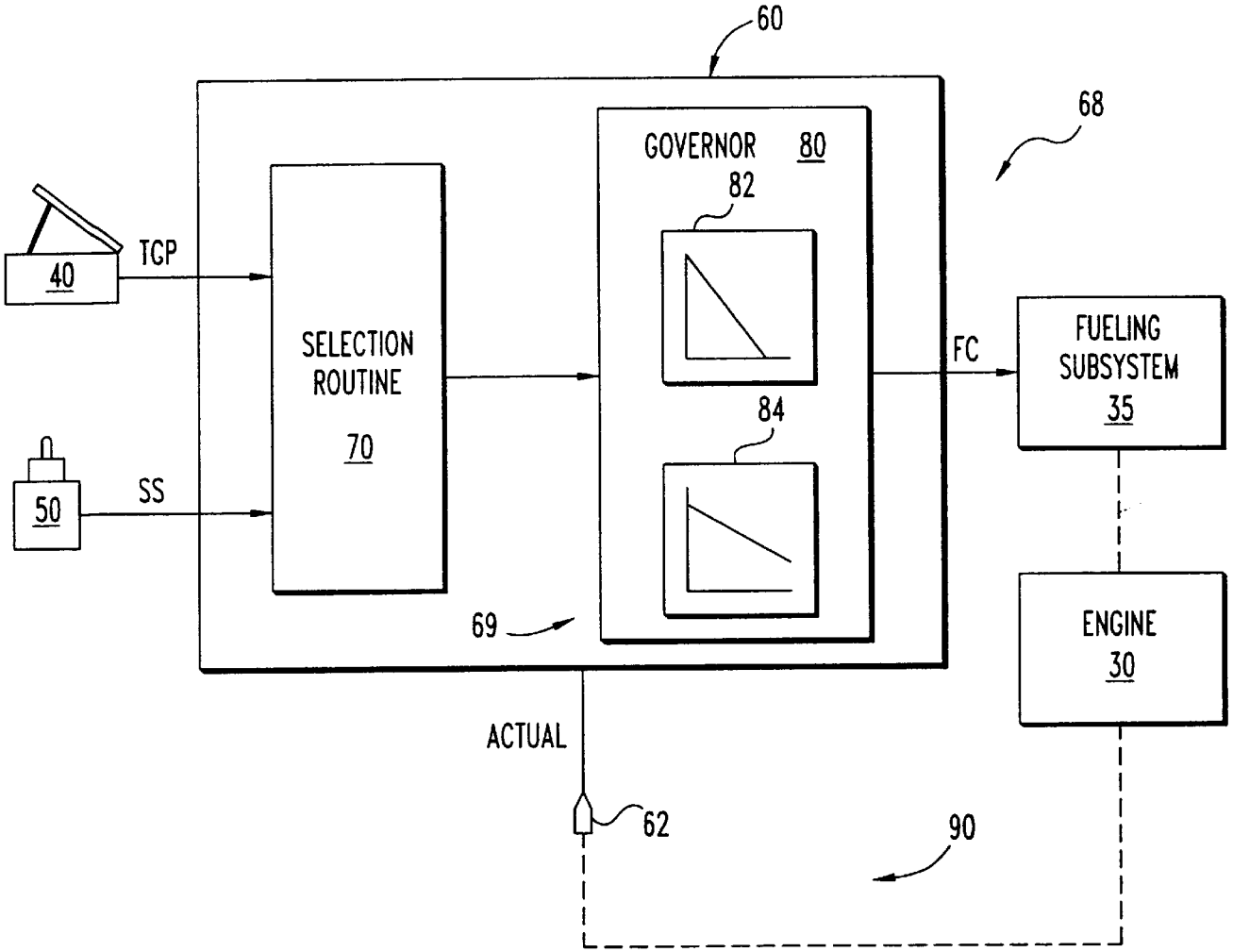
FIG. 3 is a partial schematic view further illustrating selected aspects of a control system of the embodiment of FIG. 1.

FIG. 3 illustrates engine control system 68. Control system 68 includes control elements 69 that are preferably embodied in programming or dedicated hardware of controller 60. Control elements 69 include selection routine 70 to implement a selected throttle control response or performance characteristic in accordance with the state of signal SS set with selection device 50. Controller 60 is also responsive to signal ACTUAL of sensor 62. Preferably, signal ACTUAL is utilized to provide closed loop feedback regulation of engine 30 as symbolized by arrow 90.

Different throttle control performance characteristics or qualities, as perceived by throttle control operator, are obtained by changing the type of engine control relationship utilized by governor 80 in response to routine 70. Routine 70 may also provide appropriate conditioning and mapping of the throttle control signal TCP to correspond to this selection.

Two types of engine control relationships are schematically represented in FIG. 3 as relationships or schedules 82 and 84. Relationships 82 and 84 characterize the relation between two or more parameters relative to control system 68. For example, relationship 82 or 84 may represent a predetermined relationship between engine torque and engine rotational speed. Preferably, relationships 82 and 84 are each embodied in controller 60 as a look-up table stored in memory 66 (see FIG. 2). In an alternative embodiment, relationships 82 or 84 may be represented by a corresponding mathematical expression relating the two or more parameters or through such other techniques as would occur to those skilled in the art. Further, it should be appreciated that any relationship specified between three or more parameters may be generally characterized between multiple relationships each having fewer numbers of parameters. For these variations, each of the multiple relationships generally share at least one variable or parameter with another of the multiple relationships to form a cross reference of corresponding look-up tables, expressions, or maps.

Figure 4A:
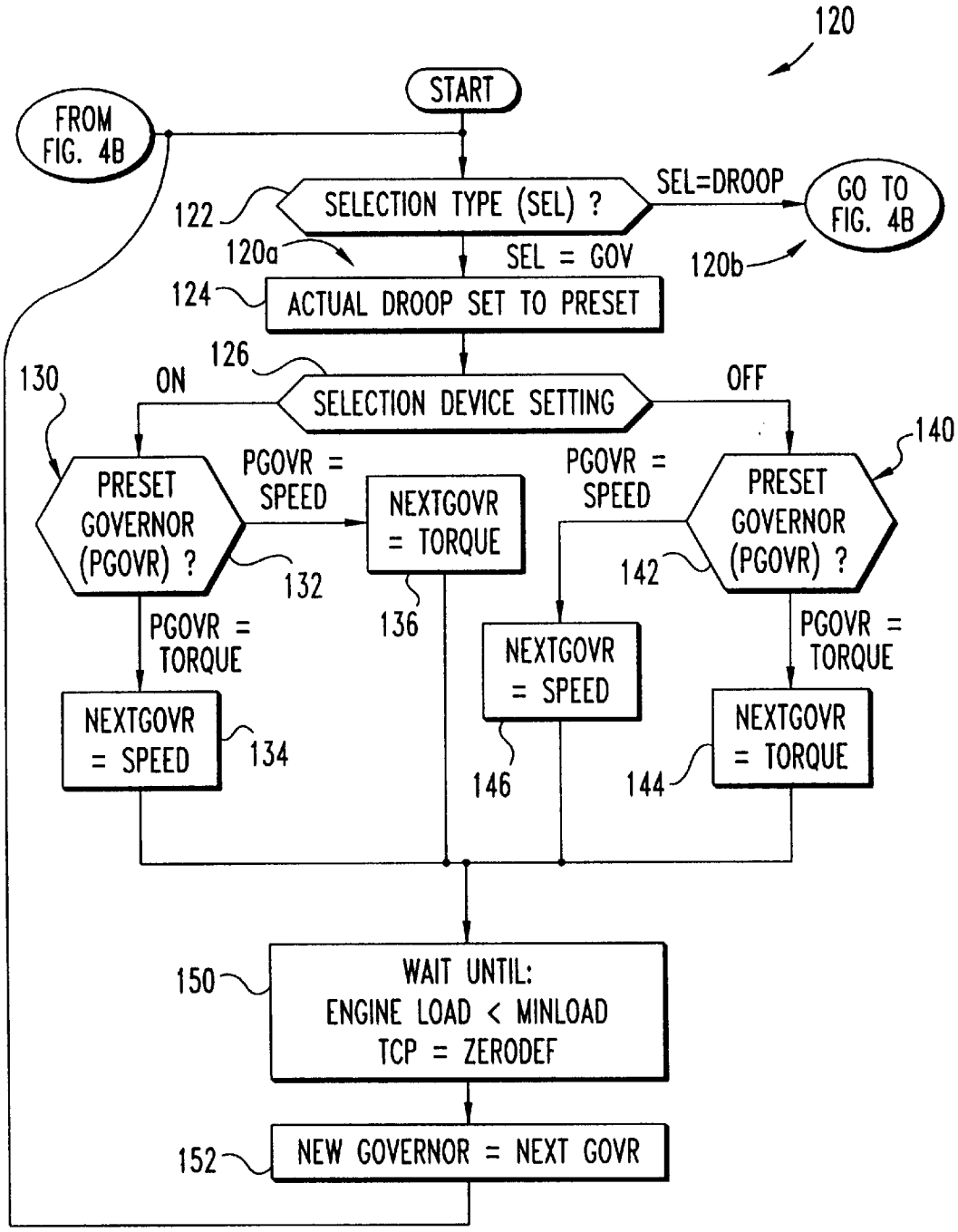
FIGS. 4A and 4B depict a flow chart showing further details of a selection routine for the control system of FIG. 3.
Figure 4B:
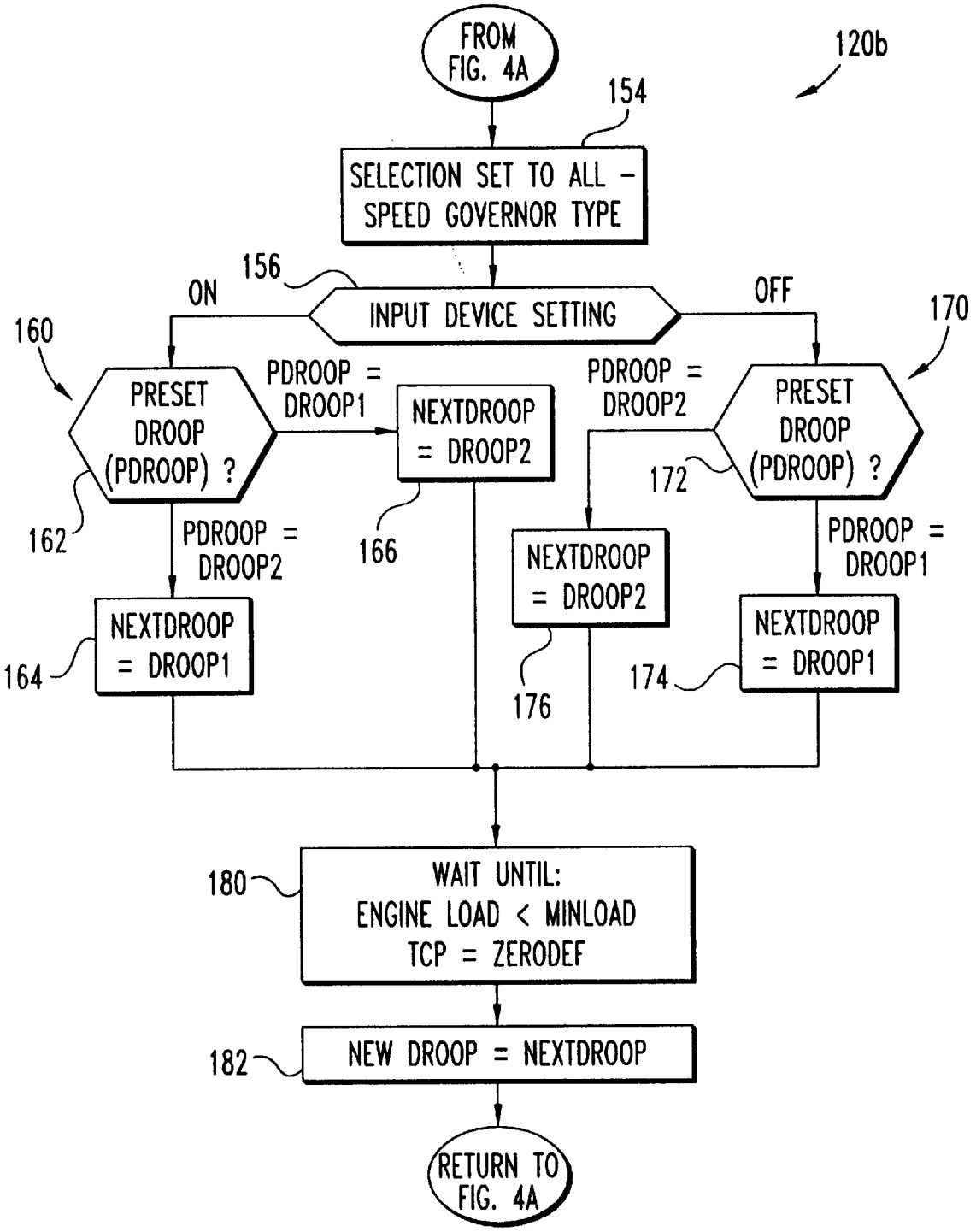

Referring additionally to the flow chart of FIGS. 4A and 4B, selection routine 70 of FIG. 3 is further illustrated. Routine 70 starts in FIG. 4A when engine 30 is started or processor 64 is reset. The first operator of routine 70 is conditional 122. Conditional 122 determines whether to execute process loop 120*a* depicted in FIG. 4A or process loop 120*b* which is principally depicted in FIG. 4B. The test of conditional 122 is based on variable SEL which is preset in controller 60. The variable SEL indicates one of two throttle control response selection options. When SEL=DROOP, selection device 50 may be used to choose between two droop factors for the all-speed type of governor. When SEL=GOV, device 50 provides selection between two different types of governors, (1) an all-speed governor and (2) a torque governor. Typically, SEL is factory preset in accordance with a predetermined configuration of vehicle 22 and engine 30.

Before proceeding further through the features of FIGS. 4A and 4B, the preferred governor and droop factor options are further described. A torque governor is commonly used in passenger automobiles and is configured so that the position of the throttle control, as represented by signal TCP, generally corresponds to engine torque. For this type of governor, maintenance of a constant vehicle speed with a torque governing arrangement typically requires adjustment of the throttle position in response to variations in the incline and decline of the road. For diesel truck engines, this type of throttle governing configuration is sometimes referred to as a "min-max" governor because it typically limits both the minimum and maximum engine speed but does not directly regulate the engine speed between these limits.

In contrast, an all-speed governor regulates engine speed throughout a continuous engine speed range. This type of governor is commonly used in truck engines, where the throttle position is directly equated to engine speed rather than engine torque. One variety of "all-speed" governor is known as an "isochronous" governor. For the isochronous governor, a constant engine speed is provided for a constant throttle position, regardless of load. A strictly isochronous all-speed governor is not normally used for on-highway applications because small changes in throttle position correspond to large changes in engine torque, making it difficult to operate a vehicle smoothly. As a result, all-speed governors are typically modified to include a "droop" factor.

Droop is a governor property that permits a steady state engine speed to slightly decrease as engine load increases. One common measurement of droop is scaled in terms of percent in accordance with the following expression:

$$\text{DROOP\%}=[(NLS-FLS)/FLS]*100\%;$$

where, NLS=no load engine speed and FLS=full load engine speed. The isochronous type of governor is at the DROOP%=0% extreme. At the other extreme, such as a DROOP% of about 60%, performance is comparable to a min-max governor. In between these extremes is a preferred droop range of about 10% to 30% for an all-speed governor. Moreover, it should be appreciated that while different predefined droop factors are provided for the all-speed governor type, the torque and all-speed governor types also each have different corresponding droop characteristics.

Conditional 122 of routine 70 tests SEL to determine whether loop 120*a* (SEL=GOV) or loop 120*b* (SEL=DROOP) is to be executed. For SEL=GOV, the selection option is between different types of governors. Correspondingly, control flows to stage 124 to establish a preset droop amount for the all-speed governor selection. Next, conditional 126 is encountered to determine the setting of the selection device 50.

When device 50 is "ON" control flows down branch 130 to conditional 132. Conditional 132 determines a preset governor type as indicated by variable PGOVR. If PGOVR=TORQUE, indicating the preset governor is the torque type, then control flows to operator 134 and an intermediate variable NEXTGOVR is set to a value representative of the all-speed type of governor (NEXTGOVR=SPEED). If PGOVR=SPEED, indicating the preset governor is of the all-speed type, then control flows to stage 136 and NEXTGOVR is assigned a value representing the torque type of governor (NEXTGOVR=TORQUE). Branch 130 then terminates with the flow of control to stage 150. In effect, branch 130 toggles the value assigned to NEXTGOVR such that it represents the type of engine governor other than the type preset in control system 60.

When the selection device setting is "OFF", control flows from conditional 126 to conditional 142 of branch 140 to once again test the preset governor type as represented by variable PGOVR. If the preset is the all-speed governor (PGOVR=SPEED), than control flows to stage 146 to assign NEXTGOVR to the same governor type (NEXTGOVR=SPEED). If the preset governor type is of the torque variety, control flows from conditional 142 to stage 144 to assign NEXTGOVR to that type (NEXTGOVR=TORQUE). Branch 140 then terminates by directing control to stage 150 as in the case of branch 130.

In stage 150 routine 70 idles until the engine load falls below a preset minimum represented by variable MINLOAD and throttle control 40 is in a predetermined position indicated by variable ZERODEF (TCP=ZERODEF). Preferably, ZERODEF represents the zero deflection position of accelerator pedal 42. Once the conditions of stage 150 are satisfied, control flows to stage 152 to set the new governor to the type represented by variable NEXTGOVR. Control then flows back to conditional 122 closing loop 120*a*.

On the other hand, if loop 120*b* of routine 70 is selected in accordance with SEL=DROOP, control flows to stage 154 of FIG. 4B. In stage 154, the type of governor is set to the all-speed governor type, but droop factor is selectable in accordance with device 50. Control flows from stage 154 to conditional 156. Conditional 156 interrogates the setting of selection device 50. If device 50 is "ON", control flows to branch 160, beginning with conditional 162. Conditional 162 determines the setting of a preset droop factor for the all-speed governor as represented by variable PDROOP. If the preset droop is set to a factor represented by DROOP2 (PDROOP=DROOP2), control flows to stage 164 to assign the intermediate variable NEXTDROOP to a different droop factor represented by DROOP1 (NEXTDROOP=DROOP1). If the preset droop is set to DROOP1 (PDROOP=DROOP1), then control flows from conditional 162 to stage 166 to set NEXTDROOP to the DROOP2 factor (NEXTDROOP=DROOP2). Thus, branch 160 sets NEXTDROOP to the droop factor other than the preset factor. Branch 160 terminates with the flow of control from stages 164, 166 to stage 180.

If the selection input device 150 is "OFF", control flows from conditional 156 to conditional 172 of branch 170. Conditional 172 tests whether the preset droop is DROOP1 or DROOP2 and correspondingly sets NEXTDROOP to the same level as included in the preset variable PDROOP. Specifically, if PDROOP=DROOP2, then NEXTDROOP=DROOP2 in stage 176. If PDROOP=DROOP1, then NEXTDROOP=DROOP1 in stage 174. Control flows from stages 174 and 176 to stage 180 terminating branch 170.

In stage 180, loop 120*b* idles until the load of engine 30 falls below MINLOAD and the throttle control achieves a predetermined condition corresponding to TCP=ZERODEF. Once these conditions are met, control flows to stage 182 which assigns the new droop factor to the factor represented by the variable NEXTDROOP. Control then returns to conditional 122 of FIG. 4A to close loop 120*b*.

Typically, because of the preset nature of SEL, either loop 120*a* or loop 120*b* will be repetitively executed in accordance with the setting of SEL. Execution of the corresponding loop continues on a scheduled basis until engine 30 is turned off or processor 64 is reset. Alternatively, routine 70 may be adapted to operate in response to an interrupt generated by a change in state of signal SS.

Governor 80 is configured to respond to the selection represented by stage 152 or 182 of routine 70 to implement the corresponding type of engine governing operation. For SEL=GOV, governor 80 is configured to provide the corresponding selected type of governor in accordance with routine 70, where each governor uses a different one of relationships 82, 84. When SEL=DROOP, governor 80 is configured to be of the all-speed governor variety with the different selectable droop factors each being provided from a different one of relationships 82, 84. Governor 80 may be implemented in any of a variety of ways for implementing the respective type of governors and selectable droops as would occur to those skilled in the art.

In one embodiment of governor 80, the all-speed configuration includes mapping TCP to a corresponding reference engine speed represented by signal REF. For this embodiment, signal ACTUAL from sensor 62 corresponds to measure engine speed which is then subtracted from signal REF to provide a control signal error designated ERR (ERR=REF−ACTUAL). Signal ERR is input to a conventional Proportional+Integral+Derivative (PID) compensator within governor 80. For SEL=DROOP, relationships 82, 84 specify the selectable droop factors within the PID compensator. For SEL=GOV, one of relationships 82, 84 is utilized for the all-speed governor PID compensator, and the other for a less complex Proportional (P) control arrangement that implements the torque governor. When the torque type of governor is selected, the signal TCP may be mapped directly using the respective engine control relationship. This torque governing relationship characterizes the input TCP in terms of a fueling command with limits corresponding to the minimum and maximum engine speeds. In other embodiments, different arrangements of control and feedback elements are envisioned using different types and numbers of control parameter relationships as would occur to those skilled in the art. In one alternative embodiment, device 50 provides more than two states of signal SS and controller 60 correspondingly includes more than two engine control relationships from which to chose with device 50.

The arrangement of routine 70 to accommodate two selection options facilitates greater flexibility and interchangability of control routines among different engine types and vehicle configurations, requiring at most the modification of various preset values such as SEL. However, in other embodiments, the application of a preset option may not be included. Preferably, routine 70 is embodied in a program executed by processor 64 using programming techniques known to those skilled in the art. In other embodiments, selection routine 70 may be embodied in dedicated hardware of controller 60. Generally, the present invention contemplates two or more types of engine governing or control relationships from which to choose a corresponding throttle control performance characteristic, quality, or response.

As used herein, it should be appreciated that: "variable," "criterion," "characteristic," "quantity," "amount," "value," "buffer," "constant," "flag," "data," "record," "factor," "threshold," "input," "output," "selection," "command," "look-up table," or "memory location" each generally correspond to one or more signals within processing equipment of the present invention.

It is contemplated that various elements, routines, operators, operations, stages, conditionals, procedures, thresholds, and processes described in connection with the present invention could be altered, rearranged, substituted, deleted, duplicated, or combined, as would occur to those skilled in the art without departing from the spirit of the present invention. All publications, patents, and patent applications cited in this specification are herein incorporated by reference as if each individual publication, patent, or patent application were specifically and individually indicated to be incorporated by reference and set forth in its entirety herein. While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method, comprising:

operating an internal combustion engine having a throttle control;

governing speed of the engine during said operating in accordance with a first one of a number of different engine speed governing relationships, response to the throttle control being different for each of the different engine speed governing relationships, the throttle control being adjustable by an operator to increase or decrease speed for each of the different engine speed governing relationships;

selecting a second one of the different engine speed governing relationships with an operator-controlled selection device; and regulating speed of the engine during said operating with the second one of the different engine speed governing relationships after said selecting.

2. The method of claim 1, wherein the first one of the relationships corresponds to an all-speed governor and the second one of the relationships corresponds to a torque governor.

3. The method of claim 1, wherein the relationships each correspond to a different degree of droop.

4. The method of claim 1, wherein the relationships each correspond to an all-speed governor with a different degree of droop.

5. The method of claim 1, further comprising propelling a vehicle with the engine, and wherein the selection device includes a switch mounted in a driver compartment of the vehicle and the throttle control includes an accelerator pedal in the driver compartment.

6. The method of claim 1, further comprising:

choosing the first one of the relationships with the selection device during said regulating;

detecting a predetermined position of the throttle control and an engine load below a predetermined minimum in response to said choosing; and changing to the first one of the relationships to regulate the engine in response to said detecting.

7. A method, comprising:

operating a vehicle propelled by a prime mover having a throttle control;

selecting between at least two speed governing relationships with an selection device, the relationships each having a different droop characteristic to provide a correspondingly different throttle control quality to a throttle control operator, the throttle control being adjustable by the operator to increase or decrease vehicle speed for each of the relationships; and regulating operation of the prime mover with a selected one of the relationships.

8. The method of claim 7, wherein a first one of the relationships corresponds to an all-speed governor and a second one of the relationships corresponds to a torque governor.

9. The method of claim 7, wherein the relationships each correspond to an all-speed governor with a different degree of droop.

10. The method of claim 7, wherein the selection device includes a switch mounted in the vehicle and the throttle control includes an accelerator pedal mounted in the vehicle.

11. The method of claim 7, further comprising:

designating a different one of the relationships with the selection device during said regulating;

detecting a predetermined position of the throttle control and an engine load below a predetermined minimum in response to said designating; and changing to the different one of the relationships to regulate the engine in response to said detecting.

12. The method of claim 7, wherein the prime mover includes a diesel-fueled internal combustion engine, the engine including a number of reciprocating pistons rotatably coupled to a crankshaft, the vehicle includes a driver compartment, the throttle control is an accelerator pedal in the driver compartment, and the selection device includes a switch mounted in the driver compartment.

13. An apparatus, comprising:

a vehicle;

an internal combustion engine to power said vehicle;

a throttle control responsive to a vehicle operator to generate a throttle setting signal to adjust engine speed;

an operator-controlled input device to generate a selection signal corresponding to a selected one of a number of predetermined engine speed governing relationships, one of the relationships corresponding to an all-speed governor and another of the relationships corresponding to a torque governor;

a controller responsive to said selection signal to govern engine speed in accordance with said selected one of said relationships and said throttle setting signal; and wherein said throttle control has a different performance characteristic for each of said relationships and is adjustable by the operator to increase or decrease vehicle speed for each of said relationships.

14. The apparatus of claim 13, wherein said selection device includes a switch mounted in said vehicle, and said throttle control includes an accelerator pedal mounted in said vehicle.

15. The apparatus of claim 13, wherein said controller detects a predetermined position of said accelerator pedal and a minimum level of engine loading before changing control of said engine in accordance with one of said relationships to another of said relationships in response to said selection signal.

16. The apparatus of claim 13, further comprising a memory coupled to said controller, said relationships each corresponding to a look-up table stored in said memory, and said controller being programmed to access said look-up table corresponding to said selected one of said relationships.

17. The apparatus of claim 13, wherein said engine is diesel-fueled, said engine has a number of reciprocating pistons rotatably coupled to a crankshaft, said vehicle includes a driver compartment, said throttle control is an accelerator pedal in said driver compartment, and said operator-controlled input device includes a switch mounted in said driver compartment.

* * * * *